US010585368B2

(12) United States Patent
Ueda et al.

(10) Patent No.: US 10,585,368 B2
(45) Date of Patent: Mar. 10, 2020

(54) ELECTROSTATIC IMAGE DEVELOPING TONER AND IMAGE FORMING METHOD

(71) Applicant: Konica Minolta, Inc., Tokyo (JP)

(72) Inventors: Junya Ueda, Hino (JP); Shinya Obara, Fuchu (JP); Takuya Takahashi, Higashimurayama (JP); Ikuko Sakurada, Hachioji (JP); Satoshi Uchino, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/194,631

(22) Filed: Nov. 19, 2018

(65) Prior Publication Data

US 2019/0212666 A1 Jul. 11, 2019

(30) Foreign Application Priority Data

Jan. 10, 2018 (JP) ..... 2018-001614

(51) Int. Cl.

| | |
|---|---|
| ***G03G 9/08*** | (2006.01) |
| ***G03G 9/097*** | (2006.01) |
| ***G03G 15/08*** | (2006.01) |
| ***G03G 9/087*** | (2006.01) |

(52) U.S. Cl.
CPC ..... *G03G 9/09708* (2013.01); *G03G 9/0819* (2013.01); *G03G 9/08711* (2013.01); *G03G 9/09716* (2013.01); *G03G 15/0865* (2013.01)

(58) Field of Classification Search
CPC ..... G03G 9/09708; G03G 9/08711
USPC ..... 430/108.1, 108.6
See application file for complete search history.

(56) References Cited

U.S. PATENT DOCUMENTS 8,163,453 B2 * 4/2012 Anno ..... G03G 9/0821 430/108.6

FOREIGN PATENT DOCUMENTS

JP H11-237766 A 8/1999

* cited by examiner

*Primary Examiner* — Mark A Chapman
(74) *Attorney, Agent, or Firm* — Lucas & Mercanti, LLP

(57) ABSTRACT

Provided is an electrostatic image developing toner containing toner mother particles having external additives on a surface of the mother particle, wherein the external additives contains calcium titanate particles having an average primary particle size in the range of 50 to 150 nm, and alumina particles; and an average primary particle size of the alumina particles is less than the average primary particle size of the calcium titanate particles.

4 Claims, 1 Drawing Sheet

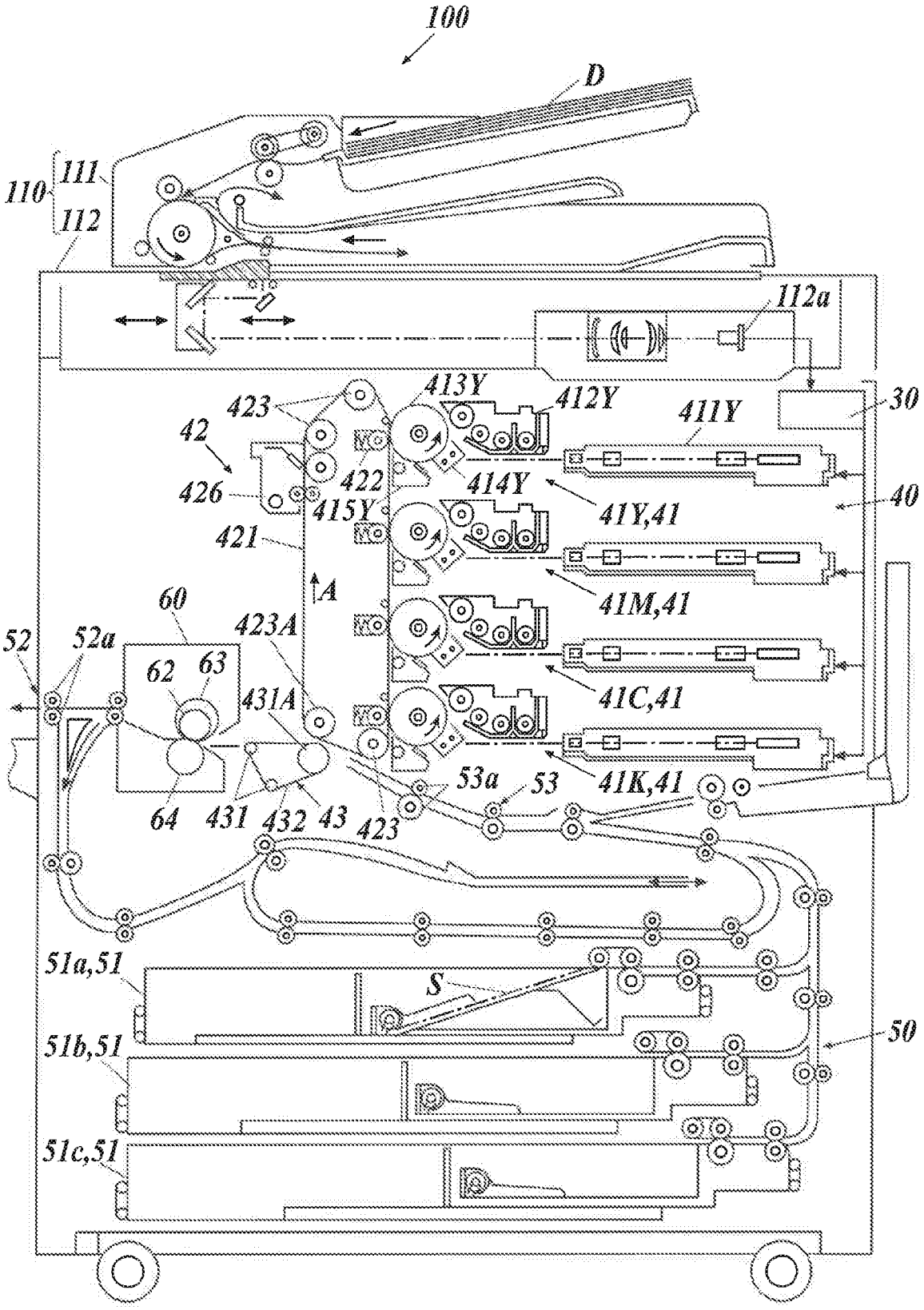
100
D
110
111
112
112a
30
40
413Y
412Y
411Y
423
42
422
426
414Y
415Y
41Y,41
421
A
41M,41
60
423A
52
52a
62
63
431A
41C,41
41K,41
53a
53
64
431
432
43
423
51a,51
S
50
51b,51
51c,51

ELECTROSTATIC IMAGE DEVELOPING TONER AND IMAGE FORMING METHOD

Japanese Patent Application No. 2018-001614, filed on Jan. 10, 2018 with Japan Patent Office, is incorporated herein by reference in its entirety.

TECHNICAL FIELD

The present invention relates to an electrostatic image developing toner and an image forming method. More specifically, the resent invention relates to an electrostatic image developing toner and an image forming method enabling to suppress image failure caused by a photoreceptor after long-term printing and to maintain high image quality.

BACKGROUND

Usually, inorganic particles and organic particles called external additives are added to the surface of the toner used for electrophotographic image formation in order to realize good image formation. It is designed to maintain toner performance such as chargeability and fluidity by the action of external additives. Among the compounds used as external additives, there are titanic acid compounds represented by calcium titanate and strontium titanate. For example, Patent Document 1 (JP-A 11-237766) discloses a toner using a titanic acid compound as an external additive. It has been known that such a toner contributes to the prevention of filming on the surface of the photoreceptor and improvement of cleaning property during image formation. In addition, the polishing action possessed by the titanic acid compound is drawing attention, and it has been known that the surface of the photoreceptor is sufficiently polished by the titanic acid compound added as an external additive to the toner in order to maintain the image forming performance.

However, the titanic acid compound has too strong abrasive properties, so that the surface of the photoreceptor may be coarsely worn or scratched. This is not preferable from the viewpoint of obtaining good image quality, such as streaky noise and density unevenness occurring on a solid image or a halftone image. Particularly, in recent years, due to progress of digitization, there are increasing cases where image formation with high gradation and high definition image quality, such as a photographic image composed of fine dot images. For this reason, image defects caused by damage of the photosensitive member produced by polishing must be avoided.

SUMMARY

The present invention was done based on the above-described problems and situations. An object of the present invention is to provide an electrostatic image developing toner and an image forming method enabling to suppress image failure caused by a photoreceptor after long-term printing and to maintain high image quality.

In order to solve the above-mentioned problem, the present inventors examined the cause of the above problem. And it was found the following. By using both calcium titanate particles and alumina particles as external additives, and by setting the particle sizes of the calcium titanate particles and the alumina particles to specific ranges, it is possible to provide an electrostatic image developing toner and an image forming method enabling to suppress image failure caused by a photoreceptor after long-term printing and to maintain high image quality. Namely, the object of the present invention is solved by the following embodiments.

An electrostatic image developing toner reflecting one aspect of the present invention is a toner comprising toner mother particles having external additives on a surface of the mother particle, wherein the external additives contains calcium titanate particles having an average primary particle size in the range of 50 to 150 nm, and alumina particles; and an average primary particle size of the alumina particles is less than the average primary particle size of the calcium titanate particles.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 1 is a schematic diagram illustrating an example of an image forming apparatus.

DETAILED DESCRIPTION OF THE EMBODIMENTS

Hereinafter, one or more embodiments of the present invention will be described with reference to the drawings. However, the scope of the invention is not limited to the disclosed embodiments.

By the embodiments described above, it is possible to provide an electrostatic image developing toner and an image forming method enabling to suppress image failure caused by a photoreceptor after long-term printing and to maintain high image quality.

A formation mechanism or an action mechanism of the effects of the present invention is not clearly identified, but it is supposed as follows. Since calcium titanate particles tend to aggregate as a material, when an external force acts on the photoreceptor, calcium titanate desorbed from the toner mother particles is aggregated. This scratches the photoreceptor and causes image defects. In view of the above, in the present invention, it has been found that when alumina particles (Mohs hardness: 6) having a smaller particle size and larger hardness than calcium titanate particles (Mohs hardness: 5) are simultaneously contained in the toner with calcium titanate particles, it is possible to suppress aggregation of calcium titanate by the detached alumina, and as a result, it is possible to suppress image defects caused by the photoreceptor. Further, when the particle size of the calcium titanate is 150 nm or less, the photoreceptor can be more uniformly polished, so that high image quality can be maintained, and when the particle size of the calcium titanate is 50 nm or more, abrasiveness may be maintained.

The electrostatic image developing toner of the present invention contains toner mother particles having external additives on a surface of the mother particle, wherein the external additives contains calcium titanate particles having an average primary particle size in the range of 50 to 150 nm, and alumina particles; and an average primary particle size of the alumina particles is less than the average primary particle size of the calcium titanate particles. This feature is a technical feature common or corresponding to the following embodiments.

In an embodiment of the present invention, it is preferable that the average primary particle size of the alumina particles is in the range of 10 to 20 nm from the viewpoint of suppression of aggregation of the calcium titanate particles and high durability.

It is preferable that the surface of the calcium titanate particles is modified with a silicone oil because the abrasion resistance with the photoreceptor is reduced and therefore the abrasion resistance is excellent.

It is preferable that the toner mother particles contain a vinyl resin from the viewpoint that suppression of embedding in the toner by alumina particles is suppressed.

The image forming method of the present invention is characterized in that an image is formed on a substrate by using the electrostatic image developing toner of the present invention. Thereby, it is possible to provide an image forming method capable of suppressing image failure caused by the photoreceptor and maintaining high image quality after long-term printing.

The present invention and the constitution elements thereof, as well as configurations and embodiments, will be detailed in the following. In the present description, when two figures are used to indicate a range of value before and after "to", these figures are included in the range as a lowest limit value and an upper limit value.

[Electrostatic Image Developing Toner]

The electrostatic image developing toner of the present invention contains toner mother particles having external additives on a surface of the mother particle, wherein the external additives contains calcium titanate particles having an average primary particle size in the range of 50 to 150 nm, and alumina particles; and an average primary particle size of the alumina particles is less than the average primary particle size of the calcium titanate particles.

<Average Primary Particle Size>

An average primary particle size of calcium titanate particles and alumina particles contained as external additives is measured as follows. One hundred primary particles of calcium titanate particles and alumina particles in a toner (one obtained by externally adding external additives to toner mother particles) are observed with a scanning electron microscope (for example, "JSM-7401F" made by JOEL Co. Ltd.) at 40,000 magnifications. The average primary particle size may be obtained by measuring the longest diameter and the shortest diameter for each particle by image analysis of primary particles and measuring the sphere equivalent diameter from this intermediate value. The average primary particle size of calcium titanate particles and alumina particles contained as external additives may be measured in a state before external addition to the toner mother particles. It may be regarded as the average primary particle size of calcium titanate particles and alumina particles contained as toner mother particles as external additives. The measurement method for that may be the same as the measurement of the average primary particle size for the calcium titanate particles and the alumina particles in the toner.

The average primary particle size of the calcium titanate particles is in the range of 50 to 150 nm. When it is 150 nm or less, the photoreceptor may be more uniformly polished, so that high image quality may be maintained, and when it is 50 nm or more, abrasiveness may be maintained. It is preferably in the range of 70 to 120 nm.

The average primary particle size of the alumina particles is smaller than the particle size of the calcium titanate particles. Specifically, it is preferably in the range of 10 to 20 nm. When it is 10 nm or more, since the alumina particles are hardly buried in the toner mother particles, they are easily detached from the toner mother particles, and aggregation of the calcium titanate particles may be further suppressed. Further, when it is 20 nm or less, since the strong abrasive power possessed by alumina itself is suppressed, high durability can be achieved by suppression of abrasion of the photoreceptor, the number of exchanging the photoreceptor is reduced, and the environmental burden is reduced.

<Production Method of Calcium Titanate Particles>

The calcium titanate particles according to the present invention may be produced by a known method. As a method for preparing the titanium calcium particles according to the present invention, there is a method of preparing titanium calcium particles through a titanium oxide (IV) compound $TiO_2.H_2O$ having a hydrate form called metatitanic acid, for example. In this method, calcium titanate is produced by reacting the titanium (IV) oxide compound with calcium carbonate and then conducting calcining treatment. Note that a hydrolyzate of titanium oxide such as metatitanic acid is also called a mineral acid deflocculating product and has a form of a liquid in which titanium oxide particles are dispersed. A water-soluble carbonate metal salt or a metal oxide is added to the mineral acid deflocculating product comprising the titanium oxide hydrolyzate, and the mixture is brought to 50° C. or higher and reacted while adding an aqueous alkali solution, whereby calcium titanate particles are produced. Metatitanic acid, one of the typical examples of mineral acid deflocculating product, has a content of sulfurous acid ($SO_3$) of 1.0 mass % or less, preferably 0.5 mass % or less, adjusted to pH 0.8 to 1.5 with hydrochloric acid and was deflocculated.

As the alkaline aqueous solution used for preparing the calcium titanate particles, a caustic alkali aqueous solution typified by a sodium hydroxide aqueous solution is preferably used. Examples of the compound to be reacted with the hydrolyzate of titanium oxide include: nitrate compounds of strontium, magnesium, calcium, barium, aluminum, zirconium and sodium; carbonate compounds; and chlorinated compounds.

In the step of preparing the calcium titanate particles, the particle size of the calcium titanate particles may be controlled by adjusting the addition ratio of the titanium oxide hydrate or the hydrolyzate and the metal oxide, the concentration of the titanium oxide hydrate or the hydrolyzate at the time of the reaction, the temperature and the addition rate at the time of adding the alkaline aqueous solution. In order to prevent formation of carbonate compounds in the reaction step, it is preferable to carry out the reaction under a nitrogen gas atmosphere.

The higher the temperature at which the alkali aqueous solution is added, the more crystalline one is obtained, but practically the appropriate range is 50 to 101° C. In addition, the addition rate of the alkali aqueous solution tends to affect the particle size of the obtained calcium titanate particles. Calcium titanate particles having a larger particle size are obtained as the addition rate is lower and those having a smaller particle size tend to be formed as the addition rate is higher. The addition rate of the alkali aqueous solution is 0.001 to 1.0 mol equivalent/hour, preferably 0.005 to 0.5 mol equivalent/hour relative to the charged material. It may be appropriately adjusted according to the desired particle size. The addition rate of the alkaline aqueous solution may be changed on the way depending on the purpose.

<Surface Modification of Calcium Titanate Particles>

It is preferable that calcium titanate particles according to the present invention are subjected to a surface modification (hydrophobilizing treatment) with a surface modification agent. As a surface modification agent, know coupling agents, silicone oils, aliphatic acids, metal salts of aliphatic acids may be used. It is preferable to use silicone compounds and silicone oils.

Examples of the silane compound include chlorosilane, alkoxysilane, silazane, and special silylation agents. More specific examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Particularly preferred examples of the hydrophobilizing agent include isobutyltrimethoxysilane, and octyltrimethoxysilane.

Specific examples of the silicone oil include cyclic compounds such as organosiloxane oligomers, octamethylcyclotetrasiloxane, decamethylcyclopentasiloxane, tetramethylcyclotetrasiloxane, and tetravinyltetramethylcyclotetrasiloxane; and straight chain or branched chain organosiloxanes. Highly reactive silicone oils having a modified-terminal at least one end may be also used, which is introduced a modified group at one or both ends of the main chain, or one end or both ends of each side chain. Non-limiting examples of the modified group include alkoxy, carboxy, carbinol, modified higher fatty acid, phenol, epoxy, methacrylic, and amino groups. Silicone oils having two or more types of modified groups such as amino and alkoxy modified groups may be also used. Dimethyl silicone oil may be mixed or combined with one or more of these modified silicone oils, optionally further with one or more of other surface modification agents.

Examples of the surface modification agent used with these silicone oils include silane coupling agents, titanate coupling agents, aluminate coupling agents, various silicone oils, fatty acids, metal salts of fatty acids, esterified compounds thereof, and rosin acids.

Examples of the surface modification method include a dry process such as a spray drying process involving spray of the silica particles suspended in a gas phase with a surface modification agent or a solution containing a surface modification agent; a wet process involving immersion of the particles in a solution containing a surface-treating agent and then drying, and a mixing process involving mixing of the particles with a treating agent in a mixer.

<Alumina Particles>

The alumina particle according to the present invention refers to aluminum oxide represented by $Al_2O_3$, and forms of α type, γ type, σ type, and a mixture thereof are known. Regarding to the shape of the particles, it is known that cubic shape to spherical shape that are produced by the control of the crystalline type.

The alumina particles according to the present invention may be prepared by a known method. As a method for preparing the alumina particles, the Bayer method is common. In order to obtain highly pure and nano-sized alumina, there are cited a hydrolysis method (manufactured by Sumitomo Chemical Co. Ltd.), a gas phase synthesis method (manufactured by CI Kasei Co. Ltd.), a flame hydrolysis method (manufactured by Nippon Aerosil Co. Ltd.), and a underwater spark discharge method (manufactured by Iwatani Chemical Industry Co. Ltd.). The surface of alumina particles is preferably subjected to surface-modification, specifically, hydrophobilizing treatment, and the degree of hydrophobicity is preferably in the range of 40 to 70. By adopting such a range, it is possible to suppress variations due to environmental differences and to suppress variations in charge amount when transferred to a carrier. In addition, it is preferable that the release rate of the hydrophobilizing treatment agent when subjected to the hydrophobilizing treatment is zero. This is because, when the released hydrophobilizing treatment agent is present, it is transferred to a carrier and the fluctuation of the charge amount increases.

<Hydrophobilizing Treatment of Alumina Particles>

(Measurement Method: Degree of Hydrophobicity)

The degree of hydrophobicity was determined by measuring using the powder wettability tester (WET-101P; manufactured by RHESCA Co. Ltd.) as follows.

In a laboratory environment, a stirrer chip of 20 mm in length and 60 mL of ion-exchanged water of 25° C. were put in a 200 mL tall beaker and set in a powder wettability tester (WET-101P; manufactured by RHESCA Co. Ltd.). 50 mg of alumina was floated on the ion-exchanged water, the lid and the methanol supply nozzle were immediately set, and the measurement was started simultaneously with the start of stirring with the stirrer. The feed rate of methanol (special grade methanol; Kanto Kagaku Co., Ltd.) was 2.0 mL/min, and the measurement time was 70 minutes. The stirring speed of the stirrer was set to 380 to 420 rpm. The toner first floats at the interface of the ion-exchanged water, but as the methanol concentration rises, the toner gradually gets wet in the mixed solution of ion exchange water and methanol and disperses in the liquid. As a result, the light transmittance of the liquid gradually decreases. From the obtained data, the methanol concentration (vol %) calculated from the methanol supply amount (mL) on the horizontal axis and the light transmittance (voltage ratio) (%) on the vertical axis are plotted. The methanol concentration at the time when the light transmittance is halfway between the maximum value and the minimum value was defined as "degree of hydrophobicity".

As the hydrophobilizing agent (surface modification agent), a common coupling agent, silicone oil, fatty acid, fatty acid metal salt may be used. A silane compound or silicone oil is preferably used. As specific examples of the silane compound and the silicone oil, the same ones as used in the surface modification agent of calcium titanate described above may be used.

Examples of the hydrophobilization method include a dry process such as a spray drying process involving spray of the silica particles suspended in a gas phase with a hydrophobilizing agent or a solution containing a hydrophobilizing agent; a wet process involving immersion of the particles in a solution containing a hydrophobilizing agent and then drying, and a mixing process involving mixing of the particles with a treating agent in a mixer.

<Other External Additives>

The toner of the present invention may further contain known external additives as external additives. Examples thereof are inorganic oxide particles such as titanium oxide particles; inorganic stearate particles such as aluminum stearate and zinc stearate particles; and inorganic titanate nanoparticles such as strontium titanate and zinc titanate particles. These inorganic particles may be subjected to a gloss and hydrophobilizing treatment with a silane coupling agent, a titanium coupling agent, higher fatty acid, or silicone oil to improve the heat-resistant storage characteristics and the environmental stability of the toner.

Organic particles may be used as other external additives. The organic nanoparticles may be spherical organic particles having a number average primary particle size of about 10 to 2,000 nm, for example. Specifically, organic particles composed of a homopolymer of styrene or methyl methacrylate or a copolymer thereof may be used.

Lubricants may be used as external additives. The lubricant is used to further improve the cleaning characteristics and transfer characteristics of the toner. Specific examples of the lubricant are metal salts of stearic acid with zinc, aluminum, copper, magnesium, and calcium; salts of oleic acid with zinc, manganese, iron, copper, and magnesium; salts of palmitic acid with zinc, copper, magnesium, and calcium; salts of linoleic acid with zinc and calcium; and salts of ricinoleic acid with zinc and calcium.

<Toner Mother Particles>

The toner mother particles according to the present invention contain a binder resin. The binder resin according to the present invention preferably contains an amorphous resin and a crystalline resin. Besides, the toner mother particles may contain other constitutional components, such as a colorant, a releasing agent (wax), and a charge controlling agent, when necessary.

A toner mother particle to which an external additive is added is called a toner particle, and an aggregate of toner particles is called a toner. In general, the toner mother particles may be used as it is, but in the present invention, toner mother particles to which external additives are added are used as toner particles.

(Amorphous Resin)

An amorphous resin according to the present invention is a resin having a relatively high glass transition temperature (Tg) but not a melting point in differential scanning calorimetry (DSC). The amorphous resin may have any glass transition temperature (Tg). The preferred glass transition temperature is in the range of 25 to 60° C. to ensure fixing characteristics, such as low-temperature fixing characteristics, and heat resistance, such as heat-resistant storage characteristics and blocking resistance. In this specification, as the glass transition temperature (Tg) of the resin, the value measured by the method described below is used.

(Measurement of Glass Transition Temperature)

The glass transition temperature (also referred to as the glass transition point) is a value measured by the method (DSC method) specified in D3418-82 of ASTM (American Society for Testing and Materials).

Specifically, 4.5 mg of the sample was precisely weighed to two decimal places, sealed in an aluminum pan, and set in a sample holder of a differential scanning calorimeter "DSC 8500" (manufactured by Perkin Elmer Co. Ltd.). An empty aluminum pan was used as a reference. Heat-Cool-Heat temperature control was carried out at a measurement temperature of −0 to 120° C., a heating rate of 10° C./min, and a cooling rate of 10° C./min, and analysis was performed based on the data in the $2^{nd}$ Heat. A cross point of an extended line of a base line before the rise of the first endothermic peak, and a tangential line indicating a maximum slope in the rise portion of the first endothermic peak to the peak apex is determined as a glass transition point (Tg).

Any amorphous resin having these characteristics may be used. Conventional amorphous resins known in this technical field may be used. Specific examples thereof include vinyl resins, urethane resins, and urea resins. Among these resins, preferred are vinyl resins because the thermoplasticity may be readily controlled.

Any vinyl resin prepared through polymerization of a vinyl compound may be used. Examples thereof include (meth)acrylate ester resins, styrene-(meth)acrylate ester resins, and ethylene-vinyl acetate resins. These vinyl resins may be used alone or in combination. Among these vinyl resins, preferred are styrene-(meth)acrylate ester resins in consideration of the plasticity of the toner during thermal fixing. The amorphous resin or the styrene-(meth)acrylate ester resin (hereinafter, also referred to as "styrene-(meth) acrylic resin") will now be described.

The styrene-(meth)acrylic resin is prepared through addition polymerization of at least a styrene monomer and a (meth)acrylate ester monomer. In this specification, the styrene monomer indicates styrene represented by the formula $CH_2{=}CH{-}C_6H_5$, and also includes monomers having a known side chain or functional group in a styrene structure. In this specification, the (meth)acrylate ester monomer indicates an acrylate or methacrylate ester compound represented by $CH_2{=}CHCOOR$ (where R is an alkyl group), and also includes ester compounds having a known side chain or functional group in the structure, such as acrylate ester derivatives and methacrylate ester derivatives. In this specification, the term "(meth)acrylate ester monomer" collectively indicates "acrylate ester monomer" and "methacrylate ester monomer".

Examples of the styrene monomer and the (meth)acrylate ester monomer usable in formation of the styrene-(meth) acrylic resin are listed below. Specific examples of the styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination.

Specific examples of the (meth)acrylate ester monomer include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate ester monomers, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate. These (meth)acrylate eatr monomers may be used alone or in combination.

The content of the structural unit derived from the styrene monomer in the styrene-(meth)acrylic resin is preferably in the range of 40 to 90 mass % relative to the total amount of the resin. The content of the structural unit derived from the (meth)acrylate ester monomer in the resin is preferably 10 to 60 mass % relative to the total amount of the resin. Besides the styrene monomer and the (meth)acrylate ester monomer, the styrene-(meth)acrylic resin may further contain the following monomer compound.

Examples of the monomer compound include compounds having a carboxy group, such as acrylic acid, methacrylic acid, maleic acid, itaconic acid, cinnamic acid, fumaric acid, monoalkyl maleate ester, and monoalkyl itaconate ester, and compounds having a hydroxy group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, and 4-hydroxybutyl (meth) acrylate. These monomer compounds may be used alone or in combination.

The content of the structural unit derived from the monomer compound in the styrene-(meth)acrylic resin is preferably in the range of 0.5 to 20 mass % relative to the total amount of the resin. The styrene-(meth)acrylic resin preferably has a weight average molecular weight (Mw) of 10,000 to 100,000.

The styrene-(meth)acrylic resin may be prepared by any process. Examples thereof include known polymerization processes, such as bulk polymerization, solution polymerization, emulsion polymerization, mini-emulsion polymerization, and dispersion polymerization, in the presence of any polymerization initiator, such as peroxide, persulfides, persulfates, or azo compounds usually used in polymerization of the monomers. A chain transfer agent usually used may also be used to control the molecular weight of the resin. Any chain transfer agent may be used. Examples thereof include alkyl mercaptans, such as n-octyl mercaptan, and mercapto aliphatic acid esters.

The binder resin can contain the amorphous resin in any content. The content of the amorphous resin is preferably more than 50 mass %, more preferably 70 mass % or more, particularly more preferably 90 mass % or more relative to the total amount of the binder resin. The content of the amorphous resin has no upper limit. In other words, the content is 100 mass % or less.

(Crystalline Resin)

The crystalline resin used in combination with the amorphous resin results in compatibilization of the crystalline resin and the amorphous resin during thermal fixing of the toner. Such compatibilization results in the low-temperature fixing of the toner, and thus further results in energy saving.

In this specification, the crystalline resin indicates a resin having a distinct endothermic peak, rather than a stepwise endothermic change, in differential scanning calorimetry (DSC). The distinct endothermic peak indicates an endothermic peak having a half width within 15° C. or less at a heating rate of 10° C./min in the DSC.

Any crystalline resin having these characteristics may be used. Commonly known crystalline resins in this technical field may be used. Specific examples of the crystalline resins include: a crystalline polyester resin, a crystalline polyurethane resin, a crystalline polyurea resin, a crystalline polyamide resin, and a crystalline polyether. These crystalline resins may be used alone or in combination of two or more kinds. Among these crystalline resins, crystalline polyester resins are preferable. In this specification, the "crystalline polyester resin" indicates a resin satisfying the endothermic characteristics described above among known polyester resins prepared by a polycondensation reaction of a di- or higher-valent carboxylic acid (polyvalent carboxylic acid) or a derivative thereof with a di- or higher-hydric alcohol (polyhydric alcohol) or a derivative thereof.

The crystalline polyester resin may have any melting point. The melting point is preferably in the range of 55 to 90° C., more preferably 60 to 85° C. A crystalline polyester resin having a melting point within this range results in a toner having sufficient low-temperature fixing characteristics. The melting point of the crystalline polyester resin may be controlled by the resin composition. In this specification, the melting point of the resin measured according to the procedure in Examples described later is used.

The polyvalent carboxylic acid and the polyhydric alcohol forming the crystalline polyester resin preferably have 2 to 3 valences, more preferably 2 valences. A divalent polyvalent carboxylic acid and a dihydric polyhydric alcohol (i.e., the dicarboxylic acid component and the diol component) will now be described.

The dicarboxylic acid component is preferably an aliphatic dicarboxylic acid in combination with an aromatic dicarboxylic acid, when necessary. A linear aliphatic dicarboxylic acid is preferred. An advantage of the linear aliphatic dicarboxylic acid is the improved crystallinity of the crystalline polyester resin. These dicarboxylic acid components may be used alone or in combination of two or more kinds.

Examples of the aliphatic dicarboxylic acid include: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid (dodecanedioic acid), 1,11-undecanedicarboxylic acid, 1,12-dodecanedicarboxylic acid (tetradecanedioic acid), 1,13-tridecanedicarboxylic acid, 1,14-tetradecanedicarboxylic acid, 1,16-hexadecanedicarboxylic acid, and 1,18-octadecanedicarboxylic acid.

Among these aliphatic dicarboxylic acids, preferred are aliphatic dicarboxylic acids having 6 to 14 carbon atoms, and more preferred are aliphatic dicarboxylic acids having 8 to 14 carbon atoms. Examples of the aromatic dicarboxylic acid usable in combination with the aliphatic dicarboxylic acid include: phthalic acid, terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, preferred are terephthalic acid, isophthalic acid, and t-butylisophthalic acid in view of availability and ease of emulsification.

These dicarboxylic acids may be replaced with polyvalent carboxylic acids having three or more valences, such as trimellitic acid and pyromellitic acid, anhydrides of these carboxylic acids, or alkyl esters having 1 to 3 carbon atoms of the dicarboxylic acids described above. In the dicarboxylic acid component that forms the crystalline polyester resin, the content of the aliphatic dicarboxylic acid is preferably at least 50 mol %, more preferably at least 70 mol %, still more preferably at least 80 mol %, most preferably 100 mol %. A dicarboxylic acid component containing at least 50 mol % of aliphatic dicarboxylic acid may sufficiently ensure high crystallinity of the polyester resin.

The diol component is preferably an aliphatic diol in combination with a diol other than an aliphatic diol, when necessary. A linear aliphatic diol is preferred. An advantage of the linear aliphatic diol is the improved crystallinity of the crystalline polyester resin. The diol components may be used alone or in combination of two or more kinds.

Examples of the aliphatic diol include: ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and neopentyl glycol.

Among these aliphatic diols, the diol component is preferably aliphatic diols having 2 to 12 carbon atoms, more preferably 3 to 10 carbon atoms. The diols that are usable in combination with the aliphatic diol are diols having a double bond or a sulfonic acid group. Specific examples of the diol having a double bond include: 1,4-butenediol, 2-butene-1, 4-diol, 3-hexene-1,6-diol, and 4-octene-1,8-diol. Further, three- or higher-hydric alcohols may be used in combination with the aliphatic diol. Examples of the three- or higher-hydric alcohols include glycerol, pentaerythritol, trimethylolpropane, and sorbitol.

In the diol component that forms the crystalline polyester resin, the content of the aliphatic diol is preferably at least 50 mol %, more preferably at least 70 mol %, still more preferably at least 80 mol %, particularly preferably 100 mol %. A diol component containing 50 mol % or more of aliphatic diol may ensure the crystallinity of the crystalline polyester resin, resulting in a toner having excellent low-temperature fixing characteristics.

The crystalline polyester resin preferably has a weight average molecular weight (Mw) of 3,000 to 100,000, more preferably 4,000 to 50,000, still most preferably 5,000 to 20,000 from the viewpoint of ensuring the compatibility between sufficient low-temperature fixing characteristics and high long-term heat-resistant storage stability. The ratio of the diol component to the dicarboxylic acid component, i.e., the ratio [OH]/[COOH] of an equivalent of hydroxy groups [OH] in the diol component to an equivalent of carboxy groups [COOH] in the dicarboxylic acid component is preferably within the range of 1.5/1 to 1/1.5, more preferably 1.2/1 to 1/1.2.

The production method of the crystalline polyester resin is not particularly limited. It may be prepared by polycondensation (esterification) of the aforesaid dicarboxylic acid and dihydric alcohol in the presence of a known esterification catalyst. Examples of the catalyst usable in preparation of the crystalline polyester resin include: compounds of alkali metals such as sodium and lithium; compounds containing Group II elements, such as magnesium and calcium; compounds of metals, such as aluminum, zinc, manganese, antimony, titanium, tin, zirconium, and germanium; phosphite compounds; phosphate compounds; and amine compounds. Specific examples of tin compounds include: dibutyltin oxide, and organic tin salts, such as tin octylate and tin dioctylate. Examples of titanium compounds include titanium alkoxides, such as tetra-n-butyl titanate, tetraisopropyl titanate, tetramethyl titanate, and tetrastearyl titanate; titanium acylates, such as polyhydroxytitanium stearate; and titanium chelates, such as titanium tetraacetylacetonate, titanium lactate, and titanium triethanolaminate. Examples of germanium compounds include germanium dioxide. Examples of aluminum compounds include aluminum oxides, such as aluminum polyhydroxide; aluminum alkoxides; and tributyl aluminate. These catalyst compounds may be used alone or in combination of two or more kinds.

The polymerization may be carried out at any temperature, preferably in the range of 150 to 250° C. Any polymerization time can be used. The preferred polymerization time is in the range of 0.5 to 15 hours. The pressure of the reaction system may be reduced during polymerization as needed.

The binder resin may contain any amount of crystalline resin (preferably, crystalline polyester resin). The content is preferably less than 50 mass %, more preferably 30 mass % or less, most preferably 10 mass % or less relative to the total amount of the binder resin. When the crystalline resin is a crystalline polyester resin, a content of less than 50 mass % may reduce the environmental dependency of the electrical charge attributed to the moisture absorption of the crystalline polyester resin. Any lower limit of the content may be used. In the binder resin containing a crystalline resin (preferably, crystalline polyester resin), the preferred content is 5 mass % or more. When the content of the crystalline resin is 5 mass % or more relative to the total amount of the binder resin, the resulting toner has high low-temperature fixing characteristics.

(Colorant)

Any colorant, such as carbon black, magnetic substances, dyes, and pigments, may be used. Examples of usable carbon black include channel black, furnace black, acetylene black, thermal black, and lamp black. Examples of the magnetic substances include ferromagnetic metals, such as iron, nickel, and cobalt; alloys containing these metals; and compounds of ferromagnetic metals, such as ferrite and magnetite.

Examples of the dyes include C.I. Solvent Reds 1, 49, 52, 58, 63, 111, and 122; C.I. Solvent Yellows 19, 44, 77, 79, 81, 82, 93, 98, 103, 104, 112, and 162; C.I. Solvent Blues 25, 36, 60, 70, 93, and 95; and mixtures thereof.

Examples of the pigments include C.I. Pigment Reds 5, 48:1, 48:3, 53:1, 57:1, 81:4, 122, 139, 144, 149, 166, 177, 178, and 222; C.I. Pigment Oranges 31 and 43; C.I. Pigment Yellows 14, 17, 74, 93, 94, 138, 155, 180, and 185; C.I. Pigment Green 7; C.I. Pigment Blues 15:3, 15:4, and 60; and mixtures thereof.

(Releasing Agent)

The releasing agent may be a variety of known waxes. Examples of the waxes include polyolefin waxes, such as polyethylene wax and polypropylene wax; branched hydrocarbon waxes, such as microcrystalline wax; long-chain hydrocarbon waxes, such as paraffin wax and SASOL wax; dialkyl ketone waxes, such as distearyl ketone; ester waxes, such as carnauba wax, montan wax, behenyl behenate, trimethylolpropane tribehenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic tristearylamide. The content of the releasing agent is preferably in the range of 0.1 to 30 mass parts, more preferably 1 to 10 mass parts relative to 100 mass parts of binder resin. These releasing agents may be used alone or in combination of two or more kinds. The preferred melting point of the releasing agent is in the range of 50 to 95° C. in view of the low-temperature fixing characteristics and releasing characteristics of the electrophotographic toner.

(Charge Controlling Agent)

A variety of known charge controlling agent particles that can be dispersed in an aqueous medium may be used. Specific examples thereof include: nigrosine dyes, metal salts of naphthenic acid or higher fatty acids, alkoxylated amines, quaternary ammonium salts, azo metal complexes, and salicylic acid metal salts or metal complexes thereof.

<External Additive Treatment>

The external additive treating step (7) will be described. An external additive may be mixed with the toner mother particles using a mechanical mixer. The mechanical mixer used may be a Henschel mixer, a Nauta Mixer, or a turbular mixer. Among these mixers, a Henschel mixer, which can impart shear force to the particles, may be used to mix the materials for a longer time or with a stirring blade at a higher circumferential speed of rotation. When several kinds of external additives are used, all of the external additives may be mixed with the toner particles in one batch, or several aliquots of the external additives may be mixed with the toner particles.

In the mixing of the external additive, the degree of crush or adhesive strength of the external additive may be controlled with the mechanical mixer through control of the mixing strength or circumferential speed of the stirring blade, the mixing time, or the mixing temperature.

[Production Method of Electrostatic Image Developing Toner]

The production method of the toner according to the present invention is not particularly limited. Any known methods may be used. Examples of the method include: a kneading pulverization method, a suspension polymerization, an emulsion aggregation method, a dissolution suspension method, a polyester extension method, and a dispersion polymerization method. Among these processes, preferred is an emulsion aggregation method in view of the uniformity of the particle size and control of the shape of the toner.

<Emulsion Aggregation Method>

In the emulsion aggregation method, toner particles are prepared as follows. A dispersion liquid of particles of a binder resin dispersed in a surfactant containing a dispersion stabilizer (hereinafter, also referred to as "binder resin particles") is mixed with a dispersion liquid of particles of a colorant (hereinafter, also referred to as "colorant particles") when necessary, and these particles are aggregated until the toner particles grow to a desired diameter. The binder resin particles are further fused to control the shapes of the toner particles. In this specification, the binder resin particles may optionally contain a mold release agent and a charge controlling agent.

As a preferable production method of the toner of the present invention, an example in which toner particles having a core-shell structure is obtained using an emulsion aggregation method is described below.

(1) a step of preparing a dispersion liquid of colorant particles dispersed in an aqueous medium, (2) a step of dispersing binder resin particles containing internal additives when necessary in aqueous media to prepare a dispersion liquid of resin particles (a dispersion liquid of resin particles for a core and a dispersion liquid of resin particles for a shell layer), (3) a step of mixing the dispersion liquid of colorant particles with the dispersion liquid of resin particles for a core to yield a resin particle dispersion liquid for aggregation, and aggregating and fusing colorant particles and binder resin particles in the presence of an aggregating agent to form aggregated particles as core material particles (aggregation and fusion step), (4) a step of adding the dispersion liquid of resin particles for a shell layer to the dispersion liquid of resin particles for a core, and aggregating and fusing the particles for a shell layer onto the surfaces of the core material particles to form toner mother particles having a core-shell structure (aggregation and fusion step), (5) a step of filtering the toner mother particles from the dispersion liquid of the toner mother particles (toner mother particles dispersion liquid) to remove the surfactant (washing step), (6) a step of drying the toner mother particles (drying step), and (7) a step of adding an external additive to the toner mother particles (external additive treating step).

The toner particles having a core-shell structure may be prepared as follows. First, binder resin particles for core material particles and colorant particles are aggregated and fused into core material particles. Then, binder resin particles for a shell layer are added to the dispersion liquid of core material particles, and the binder resin particles for a shell layer are aggregated and fused onto the surfaces of the core material particles to form a shell layer on the surfaces of the core material particles. The toner particles having a mono layer formed without adding the dispersion liquid of resin particles for a shell layer in the step (4) may be produced in the same way.

In the above-described step (7), it is possible to prepare external additives of calcium titanate particles and alumina particles subjected to surface modification in advance according to necessity. Toner particles are obtained by adding the external additives subjected to surface modification to the toner mother particles.

[Two-Component Developer for Developing Electrostatic Image]

A two-component developer for developing an electrostatic image of the present invention (hereinafter, it may be simply called as "two-component developer") is characterized in comprising the electrostatic image developing toner of the present invention and carrier particles. The carrier particles have core material particles and a coating material layer that covers the surface of the core material particles. It is preferable that the coating material contains a resin having a cycloalkyl group.

The two-component developer according to the present invention may be obtained by mixing the toner particles of the present invention and the carrier particles. The mixing apparatus used for mixing is not particularly limited, and examples thereof include a Nauta mixer, a Double cone mixer, and a V mixer. Although the content (toner concentration) of the toner in the two-component developer is not particularly limited, the content is preferably in the range of 4.0 to 8.0 mass %.

<Carrier Particles>

As carrier particles (also referred to as "carriers") which are magnetic particles used for a two-component developer, known carrier particles may be used. Examples of the carrier particles include resin-coated carrier particles composed of core particles of a magnetic substance coated with a layer of a coating material, and resin-dispersed carrier particles containing magnetic substance particles dispersed in a resin. Preferred carrier particles are resin-coated carrier particles to reduce the adhesion of the carrier particles onto a photoreceptor.

The resin-coated carrier particles will now be described. The core material particles (carrier cores) for the resin-coated carrier particles are composed of a magnetic substance or a substance strongly magnetizable in a magnetic field, for example. Examples of such a magnetic substance include ferromagnetic metals, such as iron, nickel, and cobalt; alloys and compounds containing these metals; and alloys demonstrating ferromagnetism after subjected to a heat treatment. These magnetic substances may be used alone or in combination.

Examples of the ferromagnetic metals and the alloys and compounds containing these metals include iron, ferrites represented by Formula (a), and magnetites represented by Formula (b). In Formulae (a) and (b), M represents one or more metals selected from the group consisting of Mn, Fe, Ni, Co, Cu, Mg, Zn, Cd, and Li.

$$MO.Fe_2O_3 \qquad \text{Formula (a):}$$

$$MFe_2O_4 \qquad \text{Formula (b):}$$

Examples of the alloys demonstrating ferromagnetism after subjected to a heat treatment include Heusler alloys, such as manganese-copper-aluminum and manganese-copper-tin; and chromium dioxide. Usually, the resin-coated carrier particles have a smaller specific gravity than that of the metal forming the core particles. Among these core particles, preferred are a variety of ferrites to further reduce the impact during stirring of the toner in the developer container. The surfaces of the core particles may be coated with a coating material (carrier-coating resin) to prepare resin-coated carrier particles. The coating material used in this step may be any known resin used in coating of the core material particles.

Examples of such resins include polyolefin resins, such as polyethylene and polypropylene; polystyrene resins; (meth) acrylic resins, such as polymethyl methacrylate; polyvinyl resins and polyvinylidene resins, such as polyacrylonitrile, poly(vinyl acetate), poly(vinyl alcohol), poly(vinyl butyral), and poly(vinyl chloride); copolymer resins, such as vinyl chloride-vinyl acetate copolymers and styrene-acrylate copolymers; silicone resins having organosiloxane bonds or modified resins thereof (such as resins modified with alkyd resin, polyester resin, epoxy resin, or polyurethane); fluorinated resins, such as poly(vinylfluoride); polyamide resins; polyester resins; polyurethane resins; polycarbonate resins; amino resins, such as urea-formaldehyde resins; and epoxy resins.

The preferred coating material is a resin having a cycloalkyl group to reduce the moisture adsorption of the carrier particles and enhance the adhesion between the coating material and the core particles. Examples of the cycloalkyl group include cyclopropyl, cyclobutyl, cyclopentyl, cyclohexyl, cycloheptyl, cyclooctyl, cyclononyl, and cyclodecyl groups. Among these cycloalkyl groups, preferred is a cyclopentyl or cyclohexyl group, and more preferred is a cyclohexyl group in view of the adhesion between the coating material and the core particles (preferably ferrite particles).

The carrier-coated resin as the coating material may have any weight average molecular weight (Mw). The weight average molecular weight is in the range of preferably 10,000 to 800,000, more preferably 100,000 to 750,000. The weight average molecular weight (Mw) may be determined with a gel permeation chromatograph (GPC) according to the procedure in Examples described later. The content of the structural unit having the cycloalkyl group in the resin is 10 to 90 mass %, for example. The content of the structural unit having the cycloalkyl group in the resin may be determined by pyrolysis-gas chromatography/mass spectrometry (Py-GC/MS) or $^{1}$H-NMR, for example. The coating material and the core particles may adhere to each other under mechanical impact or heat to yield carrier particles.

The carrier particles have a volume-based median diameter in the range of preferably 15 to 100 μm, more preferably 25 to 80 μm. The median diameter may be measured by the method described in Examples described later.

[Image Forming Method]

An example of a preferable image forming method using the electrostatic image developing toner of the present invention will be described with reference to the image forming apparatus illustrated in FIG. 1. The image forming method of the present invention is characterized in that an image is formed on a substrate using a toner for developing an electrostatic image of the present invention. Specifically, a preferable electrophotographic image forming method contains a charging step, an exposing step, a developing step and a transferring step. In the transfer step, it is preferable that this steps has a primary transfer step of transferring the toner image from the electrostatic latent image carrier (photoreceptor drum 413) onto the intermediate transfer body (intermediate transfer belt 421), and a secondary transfer step of transferring the toner image onto a transfer material (paper S).

An image forming apparatus 100 illustrated in FIG. 1 includes an image reading section 110, an image processing section 30, an image forming section 40, a sheet conveyance section 50, and a fixing device 60.

The image forming section 40 contains image forming units 41Y, 41M, 41C, and 41K each forming an image of each color of Y(yellow), M(magenta), C(cyan), and K(black). Since these units each have the same composition except the incorporated toner, the symbol designating the color may be omitted hereafter. The image forming section 40 further contains an intermediate transfer unit 42 and a secondary transfer unit 43. These correspond to a transfer device.

Each of the image forming units 41 includes an exposure device 411, a developing device 412, a photoreceptor drum 413, a charging device 414, and a drum cleaner 415. The photoreceptor drum 413 is a negatively-charged organic photoreceptor, for example. The surface of the photoreceptor drum 413 has a photoconductive property. The photoreceptor drum 413 corresponds to a photoreceptor. The charging device 414 is a corona discharge generator, for example. The charging device 414 may be a contact charging device which contacts with the photoreceptor drum 413 through a contact charging member such as a charging roller, a charging brush, or a charging blade to result in charging. The exposure device 411 includes a semi-conductor laser as a lighting source, and a light polarization device (polygon motor) that irradiates laser light to the photoreceptor drum 413 in accordance with the image to be formed.

The developing device 412 is a device using a two-component developing method. The developing device 412 contains: a developing container that contains a two-component developer, a developing roller (a magnetic roller) rotatably placed at the opening portion of the developing container, a partition that divides the inside of the developing container in a way that the two-component developer may communicate, a transport roller for transporting the two-component developer at the opening side of the developing container toward the developing roller, and a mixing roller that mixes the two-component developer in the developing container. The developing container contains the above-described toner as a two-component developer.

The intermediate transfer unit 42 includes an intermediate transfer belt 421, a primary transfer roller 422 that presses the intermediate transfer belt 421 to the photoreceptor drum 413, a plurality of support rollers 423 including a backup roller 423A, and a belt cleaner 426.

The intermediate transfer belt 42 is stretched in a loop state over a plurality of support rollers 423. Rotation of at least one driving roller among the plurality of support rollers 423 causes the intermediate transfer belt 421 to run in the direction indicated by an arrow A at a constant speed.

The secondary transfer unit 43 contains: a secondary transfer belt 432 having an endless shape, and a plurality of support rollers 431 including a secondary transfer roller 431A. The secondary transfer belt 43 is stretched in a loop state over support rollers 431.

The fixing device 60 includes: a fixing roller 62, a heating belt 63 of an endless belt that covers the outer peripheral surface of the fixing roller 62 so as to heat and melt the toner constituting the toner image on a sheet S, and a pressure roller 64 that presses the sheet S to the fixing roller 62 and the heating belt 63.

The image forming apparatus 100 further includes the image reading section 110, the image processing section 30, and the sheet conveyance section 50. The image reading section 110 includes a sheet feeding device 111 and a scanner 112. The sheet conveyance unit 50 includes a sheet feeding section 51, a sheet output section 52, and a sheet pathway section 53. Three tray units 51*a* to 51*c* that constitute the sheet feeding section 51 each respectively contain the predetermined sheets S (a standard sheet and a special sheet) identified based on the weight and the size. The sheet pathway section 53 contains a plurality of transport roller pairs such as a pair of register rollers 53*a*.

An image forming process with the image forming apparatus 100 will be described. The scanner 112 reads a draft D on a contact glass through optical scanning. The reflective light from the draft D is read by a CCD sensor 112*a*. This reflective light becomes an input image data. The input image data is subjected to a predetermined image processing in the image processing section 30, and it is sent to the exposure device 411.

The photoreceptor drum 413 rotates with a predetermined peripheral speed. The charging device 414 uniformly charges the surface of the photoreceptor drum 413 with a negative polarity. In the exposure device 411, a polygon mirror of the polygon motor rotated with a high speed. The laser light corresponding to the input image data of each color component is moved along with the axis direction of the photoreceptor drum 413. The laser light is irradiated in the axis direction of the outer peripheral surface of the photoreceptor drum 413. Thus, an electrostatic latent image is formed on the surface of the photoreceptor drum 413.

In the developing device 412, the toner particles are charged by mixing and transporting of the two-component developer in the developer container. The two-component developer is transported to the developing roller, and it forms a magnetic brush on the developing roller. The charged toner particles electrostatically adhere to the electrostatic latent image portion on the surface of the photoreceptor drum 413. In this way, the electrostatic latent image on the surface of the photoreceptor drum 413 is visualized. It is formed a toner image corresponding to the electrostatic latent image.

The toner image on the surface of the photoreceptor drum 413 is transferred to the intermediated transfer belt 421 in the intermediate transfer unit 42. After transfer of the toner, the remaining toner on the surface of the photoreceptor drum 413 is removed by the drum cleaner 415 having a drum cleaning blade which slidably contacts with the surface of the photoreceptor drum 413.

The intermediate transfer belt 421 is pressed against the respective photoreceptor drums 413 through the primary transfer rollers 422. As a result, there are formed primary transfer nip parts for each photoreceptor drum by the photoreceptor drums 413 and the intermediate transfer belt 421. In the primary transfer nip part, each toner image is sequentially transferred to the intermediate transfer belt 421.

On the other hand, the secondary transfer roller 431A is pressed against the backup roller 423A through the intermediate transfer belt 421 and the secondary transfer belt 432. There is formed a secondary transfer nip part by the intermediate transfer belt 421 and the secondary transfer belt 432. The sheet S passes through the secondary transfer nip part. The sheet S is transported to the secondary transfer nip part by the sheet conveyance section 50. The correction of an inclination of the sheet S and adjustment of the timing of the transport are done in the register roller section located with a pair of register rollers 53*a*.

When the sheet S is transferred to the secondary transfer nip part, a bias voltage for transfer is applied to the secondary transfer roller 431A. By application of the bias voltage for transfer, the toner images held on the intermediate transfer belt 421 are transferred onto the sheet S. The sheet S on which the toner images have been transferred is conveyed to the fixing unit 60 by the secondary transfer belt 432.

The fixing device 60 forms a fixing nip part by the heating belt 63 and the pressure roller 64. The conveyed sheet S is heated and pressed in the fixing nip part. The toner particles constituting the toner image of the sheet S are heated. The crystalline resin promptly melts in the toner particles. As a result, the whole toner particles melt with a relatively small amount of heat, and the toner component adheres to the sheet S. In this manner, the toner image is rapidly fixed on the sheet S with a relatively small amount of heat. The sheet S having a fixed image is ejected outside the apparatus through the sheet output section 52 equipped with a sheet output roller 52*a*. Thus, it is formed a high quality image.

The transfer-remaining toner remained on the surface of the intermediate transfer belt 421 after the secondary transfer is removed by the belt cleaner 426 having a belt cleaning blade that slidably contacts with the surface of the intermediate transfer belt 421.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, specific examples of the present invention will be described, but the present invention is not limited thereto.

(1) Production of Calcium Titanate Particles [1]

<Preparation of Metatitanic Acid Dispersion Liquid>

A metatitanic acid dispersion liquid was subjected to a desulfurization treatment by adding a 4.0 mol/L sodium hydroxide aqueous solution to adjust the pH value to 9.0. Then, a 6.0 mol/L hydrochloric acid aqueous solution was added to adjust the pH value to 5.5 and the mixture was neutralized. Thereafter, the metatitanic acid dispersion liquid was filtered, and washed with water to produce a cake of metatitanic acid. Water was added to the cake and a dispersion liquid containing 1.25 mol/L of $TiO_2$ (conversion value) was prepared. To this dispersion liquid was added a 6.0 mol/L hydrochloric acid aqueous solution to adjust the pH value to 1.2. Then the temperature of the dispersion liquid was adjusted to 35° C. The dispersion liquid was stirred at this temperature for one hour to carry out deflocculation of the metatitanic acid dispersion liquid.

<Reaction Step of Calcium Titanate Particles [1]>

A metatitanic acid sample corresponding to 0.156 mol of titanic acid ($TiO_2$) was taken from the metatitanic acid dispersion liquid having been subjected to deflocculation treatment, and it was placed in a reaction vessel. Subsequently, an aqueous solution of calcium carbonate ($CaCO_3$) was placed in the reaction vessel. At this time, the reaction system was adjusted so that the titanium oxide concentration was 0.156 mol/L. Calcium carbonate ($CaCO_3$) was added so that the molar ratio of $CaCO_3$ to titanium oxide was 1.15 ($CaCO_3/TiO_2$=1.15/1.00). Nitrogen gas was supplied into the above reaction vessel and allowed to stand for 20 minutes to render the inside of the reaction vessel under a nitrogen gas atmosphere. Then, the mixture solution of metatitanic acid and calcium carbonate was heated to 90° C. Subsequently, a sodium hydroxide aqueous solution was added over 14 hours until the pH became 8.0, and then the reaction was terminated by continuing stirring at 90° C. for 1 hour. After completion of the reaction, the interior of the reaction vessel was cooled to 40° C., and the supernatant liquid was removed under a nitrogen atmosphere. Then, 2,500 mass parts of pure water was charged into the reaction vessel and decantation was repeated twice. After completion of decantation, the reaction system was filtrated with Nutsche to form a cake. The obtained cake material was heated to 110° C. and dried for 8 hours in the air. The dried calcium titanate thus obtained was put in an alumina crucible, dehydrated at 930° C. and calcined. After the calcination treatment, calcium titanate was put into water and subjected to wet pulverization treatment with a sand grinder to obtain a dispersion liquid. Then, a 6.0 mol/L of hydrochloric acid aqueous solution was added to adjust the pH to 2.0 to remove excessive calcium carbonate.

<Surface Modification of Calcium Titanate Particles [1]>

After removal of the excessive calcium carbonate, wet surface modification was performed on calcium titanate by using a silicone oil emulsion (dimethylpolysiloxane emulsion) "SM 7036 EX (manufactured by Toray Dow Corning Silicone Co., Ltd.)". The surface modification was carried out by adding 1.0 mass parts of the silicone oil emulsion to 100 mass parts of calcium titanate solid content and by subjected to stirring treatment for 30 minutes. After carrying out the wet surface modification, a neutralization treatment was carried out by adjusting the pH to 6.5 by adding a 4.0 mol/L sodium hydroxide aqueous solution. Thereafter, filtration and washing were carried out and drying treatment was carried out at 150° C. Further, crushing treatment was carried out for 60 minutes using a mechanical pulverizer to prepare calcium titanate particles [1].

(2) Production of Calcium Titanate Particles [2]

In the above-described production of calcium titanate particles [1], the silicone oil emulsion was replaced with a diluted solution of isobutyltrimethoxysilane (10 mass parts of isobutyltrimethoxysilane/90 mass parts of ethanol). Surface modification was carried out by stirring for 30 minutes with a Henschel mixer under nitrogen atmosphere. At that time, treatment was carried out by adding 3.1 mass parts of isobutyltrimethoxysilane to 100 mass parts of calcium titanate solid content. Otherwise, calcium titanate particles [2] were prepared by taking the same procedure as in the production of the titanic acid compound [1].

(3) Production of Calcium Titanate Particles [3]

Calcium titanate particles [3] were produced in the same manner as the production of calcium titanate particles [1] except that the sodium hydroxide aqueous solution used in the reaction step of calcium titanate particles [1] was added over 11 hours until the pH became 8.0.

(4) Production of Calcium Titanate Particles [4]

Calcium titanate particles [4] were produced in the same manner as the production of calcium titanate particles [1] except that the sodium hydroxide aqueous solution used in the reaction step of calcium titanate particles [1] was added over 17 hours until the pH became 8.0.

(5) Production of Calcium Titanate Particles [5]

Calcium titanate particles [5] were produced in the same manner as the production of calcium titanate particles [1] except that the sodium hydroxide aqueous solution used in the reaction step of calcium titanate particles [1] was added over 20 hours until the pH became 8.0.

(6) Production of Calcium Titanate Particles [6]

Calcium titanate particles [6] were produced in the same manner as the production of calcium titanate particles [1] except that the sodium hydroxide aqueous solution used in the reaction step of calcium titanate particles [1] was added over 8 hours until the pH became 8.0.

(7) Production of Calcium Titanate Particles [7]

Calcium titanate particles [7] were produced in the same manner as the production of calcium titanate particles [1] except that the sodium hydroxide aqueous solution used in the reaction step of calcium titanate particles [1] was added over 10 hours until the pH became 8.0.

(8) Production of Alumina Particles [1]

As an example of a method for producing alumina particles, the content of Japanese Patent Application Publication No. 2012-224542 was referred to, and the known burner device described in Example 1 of European Patent No. 0585544 was adopted. Thereby alumina particles [1] were prepared.

320 kg/h of aluminum trichloride ($AlCl_3$) was evaporated in an evaporator at about 200° C., and the chloride vapor was passed by nitrogen into the mixing chamber of the burner. Here, the gas stream was mixed with 100 $Nm^3$/h of hydrogen and 450 $Nm^3$/h of air and fed to the flame via a central tube (7 mm diameter). As a result, the burner temperature was 230° C. and the discharge speed of the tube was about 35.8 m/s. 0.05 $Nm^3$/h of hydrogen was supplied as a jacket type gas via the outer tube. The gas was burned in the reaction chamber and was cooled to about 110° C. in the downstream aggregation zone. In that place, aggregation of primary particles of alumina takes place. Adherent chloride was removed from the simultaneously produced hydrochloric acid-containing gas by separating the resulting aluminum oxide particles in a filter or cyclone and treating the powder with moist air at about 500 to 700° C. Thus, alumina particles [1] having the particle size indicated in the following table were obtained. The particle size of the alumina particles may be changed depending on the reaction conditions, such as the flame temperature, the content of hydrogen or oxygen, the quality of aluminum trichloride, the retention time in the flame or the length of the aggregation zone.

<Surface Modification (Hydrophobilization) of Alumina Particles [1]>

The obtained alumina particles [1] were placed in a reaction vessel. While stirring the powder with rotating blades in a nitrogen atmosphere, a substance obtained by diluting 20 g of isobutyltrimethoxysilane as a hydrophobilizing agent with 60 g of hexane was added to 100 g of the alumina powder in the reaction vessel. After heating and stirring the mixture at 200° C. for 120 minutes, the mixture was cooled with cooling water to obtain surface-modified alumina particles [1].

(9) Production of Alumina Particles [2] to [5]

Alumina particles [2] to [5] having the particle sizes indicated in the following table were produced by appropriately changing: flame temperature, hydrogen or oxygen content rate, quality of aluminum trichloride, retention time in the flame or length of the aggregation zone in the preparation of the alumina particles [1].

The average primary particle sizes of the respective calcium titanate particles and alumina particles were measured by the above-mentioned measurement method and are indicated in the following table.

(10) Production of Toner Mother Particles

<Dispersion Liquid of Styrene-Acryl (StAc) Resin Particles>

(First Stage Polymerization)

Into a reaction vessel equipped with a stirrer, a temperature sensor, a cooling tube, and a nitrogen introducing device, a surfactant aqueous solution containing 4 mass parts of anionic surfactant containing sodium dodecyl sulfate ($C_{10}H_{21}(OCH_2CH_2)_2SO_3Na$) and 3,040 mass parts of ion-exchanged water were charged. Further, a polymerization initiator solution containing 10 mass parts of potassium persulfate (KPS) dissolved in 400 mass parts of ion-exchanged water was added thereto, and the liquid temperature was raised to 75° C.

Subsequently, to this solution was dropwise added a polymerizable monomer solution containing 532 mass parts of styrene, 200 mass parts of n-butyl acrylate, 68 mass parts of methacrylic acid, and 16.4 mass parts of n-octyl mercaptan over 1 hour. After addition, the reaction system was heated and stirred at 75° C. for 2 hours to carry out the polymerization (first stage polymerization). Thus, a dispersion liquid of styrene-acryl resin particles was prepared. A weight average molecular weight (Mw) of the styrene-acryl resin particles in the dispersion liquid was 16,500.

A weight average molecular weight (Mw) of the resin was determined from the molecular weight distribution measured by gel permeation chromatography (GPC: Gel Permeation Chromatography). Specifically, the measurement sample was added to tetrahydrofuran (THF) to a concentration of 1 mg/mL, dispersed for 5 minutes using an ultrasonic disperser at room temperature, and then treated with a membrane filter with a pore size of 0.2 μm. Thus a sample solution was prepared. A measuring device "HLC-8120 GPC" (TOSOH Corp.) and a column set "TSK guard column+3×TSK gel Super HZM-M" (TOSOH Corp.) were used. The column temperature was held at 40° C., and tetrahydrofuran (THF) was supplied at a flow rate of 0.2 mL/min as a carrier solvent. An aliquot (10 μL) of the sample solution was injected into the GPC device along with the carrier solvent and was detected by means of a refractive index (RI) detector. The molecular weight distribution of the sample was calculated by using a calibration curve, which was determined by using standard polystyrene particles. The calibration curve was obtained by using 10 kinds of monodispersed polystyrene standard particles (manufactured by Pressure Chemical Co., Ltd.). The monodispersed polystyrene standard particles each have molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$.

(Second Stage Polymerization)

Into a reaction vessel equipped with a stirrer was added a polymerizable monomer solution containing 101.1 mass parts of styrene, 62.2 mass parts of n-butyl acrylate, 12.3 mass parts of methacrylic acid, and 1.75 mass parts of n-octyl mercaptan. Further, 93.8 mass parts of paraffin wax HNP-57 (manufactured by Nippon Seiro CO. Ltd.) as a releasing agent was added, and the inner temperature of the reaction vessel was heated to 90° C. to dissolve the mixture and prepared a monomer solution. In a separate vessel, a surfactant aqueous solution prepared by dissolving 3 mass parts of the anionic surfactant used in the first stage polymerization in 1,560 mass parts of ion-exchanged water was charged, and the mixture was heated to an internal temperature of 98° C. To this aqueous surfactant solution, 32.8 mass parts (in terms of solid content) of the dispersion liquid of styrene-acrylic resin particles obtained by the first stage polymerization was added and the monomer solution containing paraffin wax was further added. The reaction system was mixed and dispersed for 8 hours by using a mechanical disperser with a circulation route "CLEARMIX" (manufactured by M Technique Co., Ltd.) so that a dispersion liquid containing emulsion particles (oil particles) having a particle size of 340 nm was prepared.

To this dispersion, a polymerization initiator solution containing 6 mass parts of potassium persulfate dissolved in 200 mass parts of ion-exchanged water was added. Polymerization (second stage polymerization) was carried out by heating and stirring the system at 98° C. for 12 hours to prepare a dispersion liquid of styrene-acrylic resin particles. A weight average molecular weight (Mw) of the styrene-acryl resin particles in the dispersion liquid was 23,000.

(Third Stage Polymerization)

A polymerization initiator solution prepared by dissolving 5.45 mass parts of potassium persulfate in 220 mass parts of ion-exchanged water was added to the dispersion liquid of styrene-acrylic resin particles obtained in the second stage polymerization. To this dispersion, a polymerizable monomer solution containing 293.8 mass parts of styrene, 154.1 mass parts of n-butyl acrylate and 7.08 mass parts of n-octyl mercaptan was dropwise added at a temperature of 80° C. over 1 hour. After completion of the dropwise addition, polymerization was carried out by heating and stirring for 2 hours (third stage polymerization) and then cooled to 28° C. to obtain a dispersion liquid of styrene-acrylic resin particles. A weight average molecular weight (Mw) of the styrene-acryl resin particles in the dispersion liquid was 26,800.

<Dispersion Liquid of Crystalline Polyester Resin Particles>

In a heat-dried three-necked flask were added 355.8 mass parts of dodecanedioic acid as a polyvalent carboxylic acid monomer, 254.3 mass parts of 1,9-nonanediol as a polyhydric alcohol monomer, and 3.21 mass parts of tin octylate as a catalyst. Air in the flask was evacuated by depressurizing operation, and then the flask was purged with nitrogen gas to make an inert atmosphere, and reflux treatment was carried out at 180° C. for 5 hours with mechanical stirring. The temperature was gradually raised in an inert atmosphere and stirred at 200° C. for 3 hours to obtain a viscous liquid product. While further cooling with air, the molecular weight of this product was measured by GPC, and when the weight average molecular weight (Mw) reached 15,000, the pressure was released and the polycondensation reaction was stopped to obtain a crystalline polyester resin. The obtained crystalline polyester resin had a melting point of 69° C. Measurement of the weight average molecular weight (Mw) and measurement of the melting point were carried out as described later.

Methyl ethyl ketone and isopropyl alcohol were added to a reaction vessel equipped with anchor blades which give stirring power. Further, the crystalline polyester resin roughly pulverized by a hammer mill was gradually added, stirred, and completely dissolved to obtain a polyester resin solution to be an oil phase. Several drops of diluted aqueous ammonia solution were dropped into the stirred oil phase, then the oil phase was dropped into ion-exchanged water to effect phase inversion emulsification, and then the solvent was removed while reducing the pressure with an evaporator. Crystalline polyester resin particles were dispersed in the reaction system, and ion-exchanged water was added to the dispersion liquid to adjust the solid content to 20 mass % to prepare a dispersion liquid of crystalline polyester resin particles.

A volume-based median diameter ($D_{50}$) of the crystalline polyester resin particles in the dispersion liquid was measured with a particle size distribution measuring instrument "Nanotrack Wave" (made by MicrotracBEL, Co. Ltd.). It was found to be 173 nm.

(Measurement of Weight Average Molecular Weight)

The weight average molecular weight was determined with a gel permeation chromatograph "HLC-8220" (made by Tosoh Corporation) provided with three columns of "TSKguard column+3×TSKgel SuperHZM-M" (made by Tosoh Corporation). While the column temperature was kept at 40° C., a carrier solvent tetrahydrofuran (THF) was fed through the columns at a flow rate of 0.2 mL/min. A sample solution (10 mL) was injected into the apparatus to measure the refractive index with a refractive index detector (RI detector). The molecular weight distribution of the sample was determined through calculation using a calibration curve determined with monodispersed standard polystyrene beads.

(Measurement of Melting Point of Crystalline Resin)

The melting point of the crystalline resin was determined with a differential scanning calorimeter "Diamond DSC" (made by PerkinElmer Inc.) as follows: A sample (3.0 mg) was sealed in an aluminum pan, and was placed on a sample holder. An empty aluminum pan was placed on a reference holder. The sample was sequentially subjected to a first heating cycle to heat the sample from 0° C. to 200° C. at a heating rate of 10° C./min, a cooling cycle to cool the sample from 200° C. to 0° C. at a cooling rate of 10° C./min, and a second heating cycle to heat the sample from 0° C. to 200° C. at a heating rate of 10° C./min to produce a DSC curve. Based on the DSC curve, the endothermic peak temperature derived from the crystalline polyester in the first heating cycle was defined as the melting point of the crystalline polyester.

<Dispersion Liquid of Amorphous Polyester Resin Particles>

Into a reaction vessel equipped with a stirring device, a nitrogen inlet tube, a temperature sensor and a rectifying column were placed the following: 139.5 mass parts of terephthalic acid and 15.5 mass parts of isophthalic acid as a polyvalent carboxylic acid monomer, 290.4 mass parts of 2-bis (4-hydroxyphenyl) propane propylene oxide 2 mol adduct (molecular weight=460) and 60.2 mass parts of 2,2-bis (4-hydroxyphenyl) propane ethylene oxide 2 mol adduct (molecular weight 404) as a polyhydric alcohol monomer. The temperature of the reaction system was increased to 190° C. over 1 hour, and after confirming that the inside of the reaction system was uniformly stirred. 3.21 mass parts of tin octylate was introduced as a catalyst. While distilling off the produced water, the temperature of the reaction system was raised from the same temperature to 240° C. over 6 hours, and the dehydrating condensation reaction was continued for 6 hours while maintaining the temperature at 240° C. to obtain an amorphous polyester resin. The amorphous polyester resin thus obtained had a peak molecular weight (Mp) of 12,000 and a weight average molecular weight (Mw) of 15,000. A dispersion liquid of amorphous polyester resin particles having a solid content of 20 mass % was prepared by performing the same operation as in the preparation of the dispersion liquid of crystalline polyester resin particles to the obtained amorphous polyester resin. A volume-based median diameter ($D_{50}$) of the amorphous polyester resin particles in the dispersion liquid was measured with a particle size distribution measuring instrument "Nanotrack Wave" (made by MicrotracBEL, Co. Ltd.). It was found to be 216 nm.

<Dispersion Liquid of Colorant Particles>

90 mass parts of sodium dodecyl sulfate were dissolved with stirring in 1,600 mass parts of ion-exchanged water. While stirring this solution, 420 mass parts of carbon black "REGAL 330R" (made by Cabot Corporations) were gradually added to the solution. Then, the dispersion liquid was dispersed with a stirrer "Cleamix" (made by M Technique Co., Ltd.) to prepare a dispersion liquid of colorant particles.

A volume-based median diameter ($D_{50}$) of the colorant particles in the colorant particle dispersion liquid was measured with a particle size distribution measuring instrument "Nanotrack Wave" (made by MicrotracBEL, Co. Ltd.). It was found to be 117 nm.

<Production of Toner Mother Particles [1]>

Into a 5 L stainless steel reaction vessel equipped with a stirrer, a cooling tube and a temperature sensor, the following ingredients were placed as first addition dispersion liquids: 270 mass parts (in terms of solid content) of styrene-acrylic resin particle dispersion liquid, 270 mass parts (in terms of solid content) of amorphous polyester resin particle dispersion liquid. 60 mass parts (in terms of solid content) of crystalline polyester resin particle dispersion liquid, 48 mass parts (in terms of solid content) of the colorant particle dispersion liquid. Further, 380 mass parts of ion-exchanged water were added and the pH was adjusted to 10 using 5 (mol/L) sodium hydroxide aqueous solution with stirring. 5.0 mass parts of 10 mass % polyaluminum chloride aqueous solution was added dropwise over 10 minutes with stirring, and the internal temperature was raised to 75° C. The particle size of the obtained particles was measured by using a "Coulter Multisizer 3" (Beckman Coulter, Inc. Aperture diameter 50 μm). When the average particle size reached 5.8 μm, an aqueous solution of 160 mass parts of sodium chloride dissolved in 640 mass parts of ion-exchanged water was added to terminate the particle growth. Then, the reaction system was further heated and stirred to allow fusion of the particles to proceed. When the average circularity of the toner reached 0.960, the reaction system was cooled to 25° C. at a cooling rate of 20° C./min. The average circularity of the particles was measured by a flow type particle image measuring apparatus FPIA-2100 (manufactured by Sysmex Corporation). After cooling, solid-liquid separation was carried out using a basket type centrifuge. The obtained wet cake was washed with ion exchanged water at 35° C. with the same basket type centrifuge until the electric conductivity of the filtrate reached 5 μS cm. Thereafter, it was transferred to a flash jet dryer (manufactured by Seishin Enterprise Co., Ltd.) and dried until the water content reached 0.5 mass %.

<Production of Toner Mother Particles [2]>

Toner mother particles [2] were produced in the same manner as preparation of the toner mother particles [1] except that the following change was done to the ingredients in the preparation of toner mother particles [1]: 540 mass parts of amorphous polyester resin particles, 60 mass parts (in terms of solid content) of crystalline polyester resin particle dispersion, and 48 mass parts of colorant particle dispersion liquid (in terms of solid content).

(11) Production of Toner

<Production of Toner [1]>

(External Additive Treatment)

To the toner mother particles [1] produced as described above, the following materials were added: 0.5 mass % of calcium titanate particles [1]; and 0.5 mass % of alumina particles [1]. The mixture was placed in a Henschel mixer model "FM 20C/I" (manufactured by Nippon Coke & Engineering Co., Ltd.) with setting the rotation number so that the blade tip circumferential speed was 40 nm/s, and stirred for 20 minutes to obtain a toner [1] containing the toner particles [1]. Further, the temperature at the time of mixing external additives was set to be 40° C.±1° C. When the temperature became 41° C., cooling water was flowed into the outer bath of the Henschel mixer at a flow rate of 5 L/min, and when the temperature became 39° C., the cooling water was flowed at a flow rate of 1 L/min. Thus, temperature control inside the Henschel mixer was carried out.

<Production of Toners [2] to [13]>

Toners [2] to [13] were produced in the same manner as production of the toner [1] as described above except that the types of toner mother particles, calcium titanate particles and alumina particles were changed as indicated in the following table.

(12) Production of Developer

A ferrite carrier covered with a copolymer resin of cyclohexyl methacrylate and methyl methacrylate (monomer mass ratio=1:1) and having a volume average particle size of 30 μm was added to the above-described toners [1] to [13] so that the mixing ratio of the toner and the carrier became to be 6 mass % and 100 mass %. The toner and the carrier were mixed by using a V blender under the environment of normal temperature and normal humidity (temperature 10° C., relative humidity 20% RH; temperature 30° C., relative humidity 80% RH). The processing was carried out with setting the rotation number of the V blender to be 20 rpm and the stirring time to be 20 minutes, and the mixture was filtered with a mesh having an opening of 125 μm to prepare each developer.

(13) Evaluation Methods

<Maintaining of Graininess>

(Initial Stage of Printing: Case in which Printing is Done at a Normal Printing Rate)

Developers [1] to [13] were mounted on a developing device of a commercially available color multi-functional peripheral (MFP) "bizhub PRO C6500" (manufactured by Konica Minolta, Inc.). 1,000 sheets and 100,000 sheets of printing for forming a belt-like solid image were performed on A4 size high quality paper (65 g/m$^2$) with a printing rate of 5% under a low temperature and low humidity environment (temperature 10° C., humidity 15% RH). A gradation patter of 32 gradation levels was outputted. Fourier transformation processing in which MTF (Modulation Transfer Function) correction was taken into account was applied to the reading value of the gradation pattern by the CCD. GI value (Graininess Index) according to human relative visibility was measured, and the maximum graininess was determined. The smaller the GI value is, the better it is, and the smaller the GI value, the lower the graininess of the image is. This GI value is the value disclosed in the Journal of the Imaging Society of Japan 39 (2), 84-93 (2000). The graininess of the gradation pattern in the image was evaluated according to the following evaluation criteria. For the image of the gradation pattern initially outputted, it was judged based on the following criteria based on the maximum GI value (GIi) in the image. The evaluation of GIi was performed on the images of 1001st sheet and 100,001st sheet.

(Evaluation Criteria)

On the difference of GIi value between 100,001st and 1001 st sheets

○: GIi value difference is less than 0.01 (pass an examination)

X: GIi value difference is 0.01 or more (fail an examination)

<Filming Property>

The surface of the photoreceptor after printing of 100,000 sheets under the above conditions was observed and filming was confirmed.

(Evaluation Criteria)

○: Occurrence of filming on the surface of the photoreceptor is not confirmed (passing an examination)

X: Occurrence of filming on the surface of the photoreceptor is confirmed, the filming level poses practical problems (failing an examination)

<Photoreceptor Scratches>

100,000 sheets were printed under the above conditions, a halftone image was outputted, and the presence or absence of streaks on the image due to surface scratches on the photoreceptor was evaluated. The evaluated photoreceptor is a photoreceptor placed at the cyan position.

◎: No problem in halftone image after printing 100,000 sheets (excellent)

○: A streak is not detected in the halftone image after printing 100,000 sheets, but the image has a rough feeling (practically no problem)

X: Streaks due to surface scratches are confirmed in the halftone images after printing 100,000 sheets (there is a problem in practical use)

<Abrasion Resistance>

After printing 500,000 sheets under the above conditions, the film thickness of the surface layer of the photoreceptor was measured, the amount of depletion of the surface layer was calculated and evaluated according to the following evaluation criteria. For measurement of the film thickness, an eddy current type film thickness measuring machine "Fischer scope MMS PC" (manufactured by Fischer Instruments Co. Ltd.) was used.

(Evaluation Criteria)

◎: Amount of depletion is not more than 0.3 μm (passing an examination)

○: Amount of depletion is larger than 0.3 μm and not more than 0.6 μm (passing an examination)

Δ: Amount of depletion is larger than 0.6 μm and not more than 1.0 μm (failing an examination)

X: Amount of depletion is larger than 1.0 μm (failing an examination)

TABLE I

| | | | Calcium titanate particles | | | Alumina particles | | Maintaining of graininess | | | | Abrasion resistance | | |
|---|---|---|---|---|---|---|---|---|---|---|---|---|---|---|
| Developer No. | Toner No. | Toner mother particles No. | No. | Particle size (nm) | Surface modification agent | No. | Particle size (nm) | GIi value difference | Evaluation | Filming | *1 | Amount of depletion (μm) | Evaluation | Remarks |
| 1 | 1 | 1 | 1 | 100 | Silicone oil | 1 | 17 | 0.003 | ○ | ○ | ◎ | 0.2 | ◎ | Present invention |
| 2 | 2 | 1 | 1 | 100 | Silicone oil | 2 | 10 | 0.004 | ○ | ○ | ◎ | 0.2 | ◎ | Present invention |
| 3 | 3 | 1 | 1 | 100 | Silicone oil | 3 | 6 | 0.006 | ○ | ○ | ○ | 0.2 | ◎ | Present invention |
| 4 | 4 | 1 | 1 | 100 | Silicone oil | 4 | 25 | 0.002 | ○ | ○ | ◎ | 0.5 | ○ | Present invention |
| 5 | 5 | 1 | 2 | 100 | *2 | 1 | 17 | 0.004 | ○ | ○ | ◎ | 0.4 | ○ | Present invention |
| 6 | 6 | 1 | 3 | 52 | Silicone oil | 1 | 17 | 0.002 | ○ | ○ | ◎ | 0.2 | ◎ | Present invention |
| 7 | 7 | 1 | 4 | 149 | Silicone oil | 1 | 17 | 0.007 | ○ | ○ | ◎ | 0.4 | ○ | Present invention |

TABLE I-continued

| Developer No. | Toner No. | Toner mother particles No. | Calcium titanate particles No. | Calcium titanate particles Particle size (nm) | Surface modification agent | Alumina particles No. | Alumina particles Particle size (nm) | Maintaining of graininess GIi value difference | Maintaining of graininess Evaluation | Filming | *1 | Abrasion resistance Amount of depletion (μm) | Abrasion resistance Evaluation | Remarks |
|---|---|---|---|---|---|---|---|---|---|---|---|---|---|---|
| 8 | 8 | 2 | 1 | 100 | Silicone oil | 1 | 17 | 0.003 | ○ | ○ | ○ | 0.2 | ◎ | Present invention |
| 9 | 9 | 1 | 5 | 170 | Silicone oil | 1 | 17 | 0.012 | X | ○ | ○ | 0.8 | Δ | Comparative example |
| 10 | 10 | 1 | 6 | 40 | Silicone oil | 1 | 17 | 0.002 | ○ | X | ◎ | 0.1 | ◎ | Comparative example |
| 11 | 11 | 1 | — | — | Silicone oil | 1 | 17 | 0.003 | ○ | X | ◎ | 0.1 | ◎ | Comparative example |
| 12 | 12 | 1 | 1 | 100 | Silicone oil | — | — | 0.003 | ○ | ○ | X | 0.2 | ◎ | Comparative example |
| 13 | 13 | 1 | 7 | 55 | Silicone oil | 5 | 60 | 0.004 | ○ | ○ | X | 1.1 | X | Comparative example |

*1: Photoreceptor scratches
*2: Isobutyltimethoxysilane

From the above evaluation results indicated in the table, it is recognized that the toner of the present invention is excellent in terms of maintaining graininess, filming property, scratches and abrasion resistance on the photoreceptor, as compared with the toner of the comparative example.

What is claimed is:

1. An electrostatic image developing toner comprising:

toner mother particles having external additives on a surface of the mother particle;

wherein the external additives contain calcium titanate particles having an average primary particle size in the range of 50 to 150 nm, and alumina particles; and an average primary particle size of the alumina particles is less than the average primary particle size of the calcium titanate particles;

wherein the calcium titanate particles are surface-modified with either a silane compound or a silicone oil;

wherein the average primary particle size of the alumina particles is in the range of 6 to 25 nm; and wherein the alumina particles are surface-modified with either a silane compound or a silicone oil, and the surface-modified alumina particles have a degree of hydrophobicity of 40 to 70.

2. The electrostatic image developing toner described in claim 1, wherein the average primary particle size of the alumina particles is in the range of 10 to 20 nm.

3. The electrostatic image developing toner described in claim 1, wherein the toner mother particles contain a vinyl resin.

4. An image forming method comprising a step of forming an image on a substrate using the electrostatic image developing toner described in claim 1.

* * * * *